US008366521B2

(12) United States Patent
Kim

(10) Patent No.: US 8,366,521 B2
(45) Date of Patent: Feb. 5, 2013

(54) DIAMOND TOOL FABRICATED BY COMBINING MESH NET WITH SYNTHETIC RESIN MATERIAL

(76) Inventor: Hye Young Kim, Gyeonggi-do (KR)

( * ) Notice: Subject to any disclaimer, the term of this patent is extended or adjusted under 35 U.S.C. 154(b) by 495 days.

(21) Appl. No.: 12/515,548

(22) PCT Filed: Nov. 21, 2007

(86) PCT No.: PCT/KR2007/005862

§ 371 (c)(1),
(2), (4) Date: Dec. 11, 2009

(87) PCT Pub. No.: WO2008/063001

PCT Pub. Date: May 29, 2008

(65) Prior Publication Data

US 2010/0232891 A1 Sep. 16, 2010

(30) Foreign Application Priority Data

Nov. 22, 2006 (KR) ..... 10-2006-0115980

(51) Int. Cl.
*B23F 21/02* (2006.01)

(52) U.S. Cl. ..... 451/548; 451/546

(58) Field of Classification Search ..... 451/526–558
See application file for complete search history.

(56) References Cited

U.S. PATENT DOCUMENTS

| | | | | |
|---|---|---|---|---|
| 2,624,987 | A * | 1/1953 | Loofboro et al. | 451/548 |
| 3,685,215 | A * | 8/1972 | Bates | 451/546 |
| 6,095,912 | A * | 8/2000 | Ferronato | 451/526 |
| 6,371,842 | B1 * | 4/2002 | Romero | 451/540 |
| 6,875,099 | B2 * | 4/2005 | Stepanovich | 451/548 |

* cited by examiner

*Primary Examiner* — Dung Van Nguyen
(74) *Attorney, Agent, or Firm* — Porzio, Bromberg & Newman, P.C.

(57) ABSTRACT

Disclosed therein is a diamond tool fabricated by combining a mesh net with a synthetic resin material, which includes a diamond sintered body integrally coupled with the outer surface of the mesh net and a synthetic resin material impregnated into the inner surface of the mesh net, thereby maximizing a bonding strength and minimizing weight. The diamond tool includes: a diamond sintered body having a diamond tip; a mesh net integrally coupled with the sintered body in such a way that a portion of the sintered body is impregnated therewith; and a synthetic resin material for forming a body in such a way as to couple the mesh net with the circumference of the sintered body to thereby expose the sintered body to the outside.

11 Claims, 3 Drawing Sheets

DIAMOND TOOL FABRICATED BY COMBINING MESH NET WITH SYNTHETIC RESIN MATERIAL

CROSS REFERENCE TO RELATED APPLICATION

This is a National Stage of International Application PCT/KR2007/005862, filed 21 Nov. 2007, which claims the benefit of Application No. 10-2006-0115980, filed in Korea on 22 Nov. 2006, the disclosures of which Applications are incorporated by reference herein.

TECHNICAL FIELD

The present invention relates to a diamond tool fabricated by combining a mesh net with a synthetic resin material, and more particularly, to a diamond tool fabricated by combining a mesh net with a synthetic resin material, which includes a diamond sintered body integrally coupled with the outer surface of the mesh net and a synthetic resin material impregnated with the inner surface of the mesh net, thereby maximizing a bonding strength and minimizing weight.

BACKGROUND ART

In general, diamond tools mean tools using natural diamond or artificial diamond. For the diamond tools, there are a diamond dresser (tool for dressing a grinding stone), a diamond bite (tool for cutting), a diamond dice (tool for drawing a line), a diamond drilling bit (tool for boring), a diamond wheel (tool for grinding and cutting), a diamond glass knife, a diamond needle, and so on. Such diamond tools use properties of diamond, namely, hardness, a good wear rate and a low coefficient of thermal expansion of diamond, to the industrial production. The diamond tools make a great contribution toward improvement of quality by enhancing precision of industrial products.

Particularly, a diamond tool according to the present invention has a number of diamond particles bonded on the outer peripheral surface of a metal shank, and cuts and processes an object being grinded having fragility, such as stone, bricks, concrete, asphalt, and so on. In addition, the present invention is related with a disc type diamond tool used for grinding. Such a disc type diamond tool can be manufactured through a sintering method, a metal fusing method, a metal electrodeposition method, and so on.

In the meantime, since a metal bonding method, which is one of the methods of manufacturing the diamond tool, has an excellent cutting force and a long lifespan, it shows a good performance when it cuts and grind stone and concrete. However, in an aspect of its constituent elements, the metal bonding method has several problems in that it is difficult to manufacture tools having flexibility and the tool can be coupled with a body only by welding since it is made of metal. So, the metal bonding method has a restriction in a bonding method even though the body of the tool is made of rubber or plastic. So, the metal bonding method cannot be applied actually even though it has various advantages in aspects of weight, productivity, price, and so on.

The above problem occurs since metal does not have flexibility and gets broken even though it is made thin.

In addition, the diamond tool basically needs a strong and safe bonding for its good performance when it is coupled with other materials. However, if the diamond tool is bonded with the materials with general adhesives, it has several problems in that it is deteriorated in strength and does not provide safety, which is one of the basically necessary conditions, since it is weak to the external factors, such as heat and shock.

DISCLOSURE OF INVENTION

Technical Problem

Accordingly, the present invention has been made in an effort to solve the above-mentioned problems occurring in the prior arts, and it is an object of the present invention to provide a diamond tool fabricated by combining a mesh net with a synthetic resin material, which utilizes a light material of hetero-materials by impregnating a synthetic resin material to a mesh net and impregnating a diamond sintered body to the mesh net.

Technical Solution

To achieve the above objects, the present invention provides a diamond tool fabricated by combining a mesh net with a synthetic resin material comprising: a diamond sintered body having a diamond tip; a mesh net integrally coupled with the sintered body in such a way that a portion of the sintered body is impregnated therewith; and a synthetic resin material for forming a body by coupling the mesh net with the circumference of the sintered body in such a way as to expose the sintered body to the outside.

The mesh net can be formed in such a way as to cross metal wires. The mesh net may have embossed portions formed at locations corresponding to the diamond sintered bodies, and be in an annular disc form or a hollow cylinder form.

In addition, the synthetic resin material can be selected from a group containing rubber, urethane and plastic, the diamond sintered body may be a metal diamond sintered body, the mesh net may be a metal mesh net of a steel material or a metal sheet having a number of through-holes, and the synthetic resin material may be thermoplastic resin or thermosetting resin.

Furthermore, the synthetic resin material is adapted to form a body in such a way as to be coupled with the sintered body at the same height as the top of the sintered body, so that the top of the sintered body is exposed to the outside. Additionally, the diamond sintered bodies are arranged on a concentric circle in a circumferential direction at regular intervals.

The above and other objects, features and advantages of the present invention will be apparent from the following detailed description of the preferred embodiments of the invention in conjunction with the accompanying drawings.

Advantageous Effects

As described above, the diamond tool according to the present invention can maximize a bonding strength by impregnating the synthetic resin material with the inner surface of the mesh net since the diamond sintered body is coupled integrally with the outer surface of the mesh net. In addition, the diamond tool according to the present invention can minimize its weight, and so, maximize convenience in delivery and work.

EXPLANATION ON REFERENCE NUMERALS OF MAIN ELEMENTS IN DRAWINGS

Figure 1:
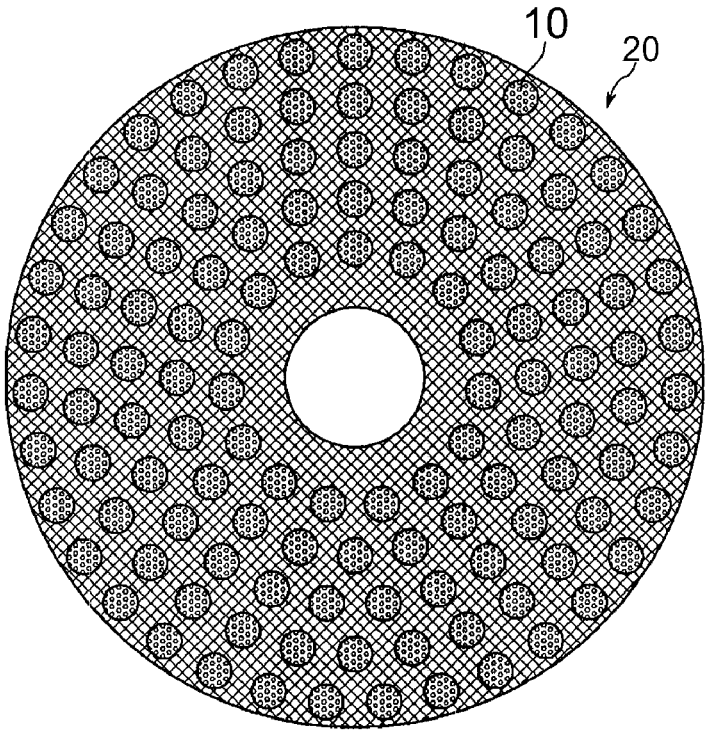
FIG. 1 is a front view of a mesh net, on which a diamond sintered body is sintered according to the present invention.

10: diamond sintered body
20: mesh net
30: synthetic resin body

MODE FOR INVENTION

Reference will be now made in detail to the preferred embodiment of the present invention with reference to the attached drawings. In the drawings, the same components have the same reference numerals even though they are illustrated in different figures. In addition, in the description of the present invention, when it is judged that detailed descriptions of known functions or structures related with the present invention may make the essential points vague, the detailed descriptions of the known functions or structures will be omitted.

Figure 2:
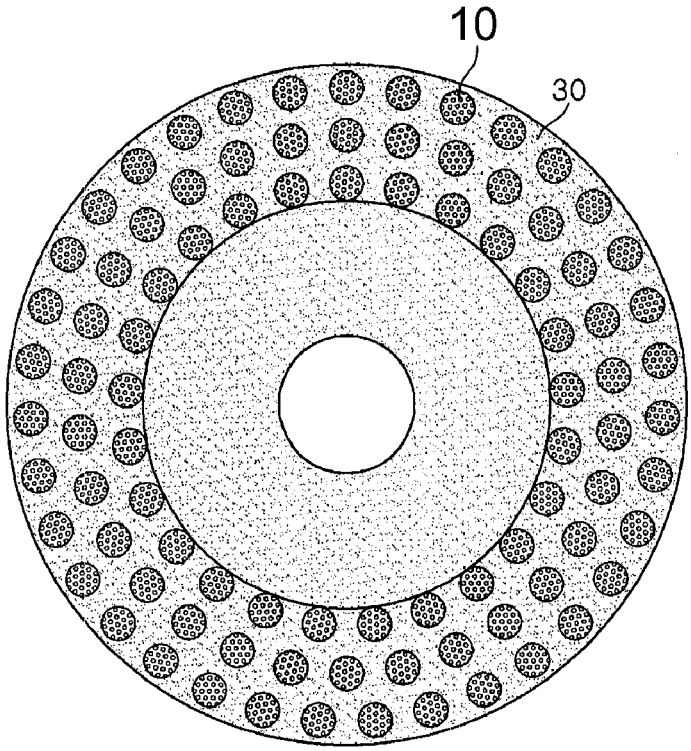
FIG. 2 is a front view showing a state where a synthetic resin body is molded in the state of FIG. 1.
Figure 3:
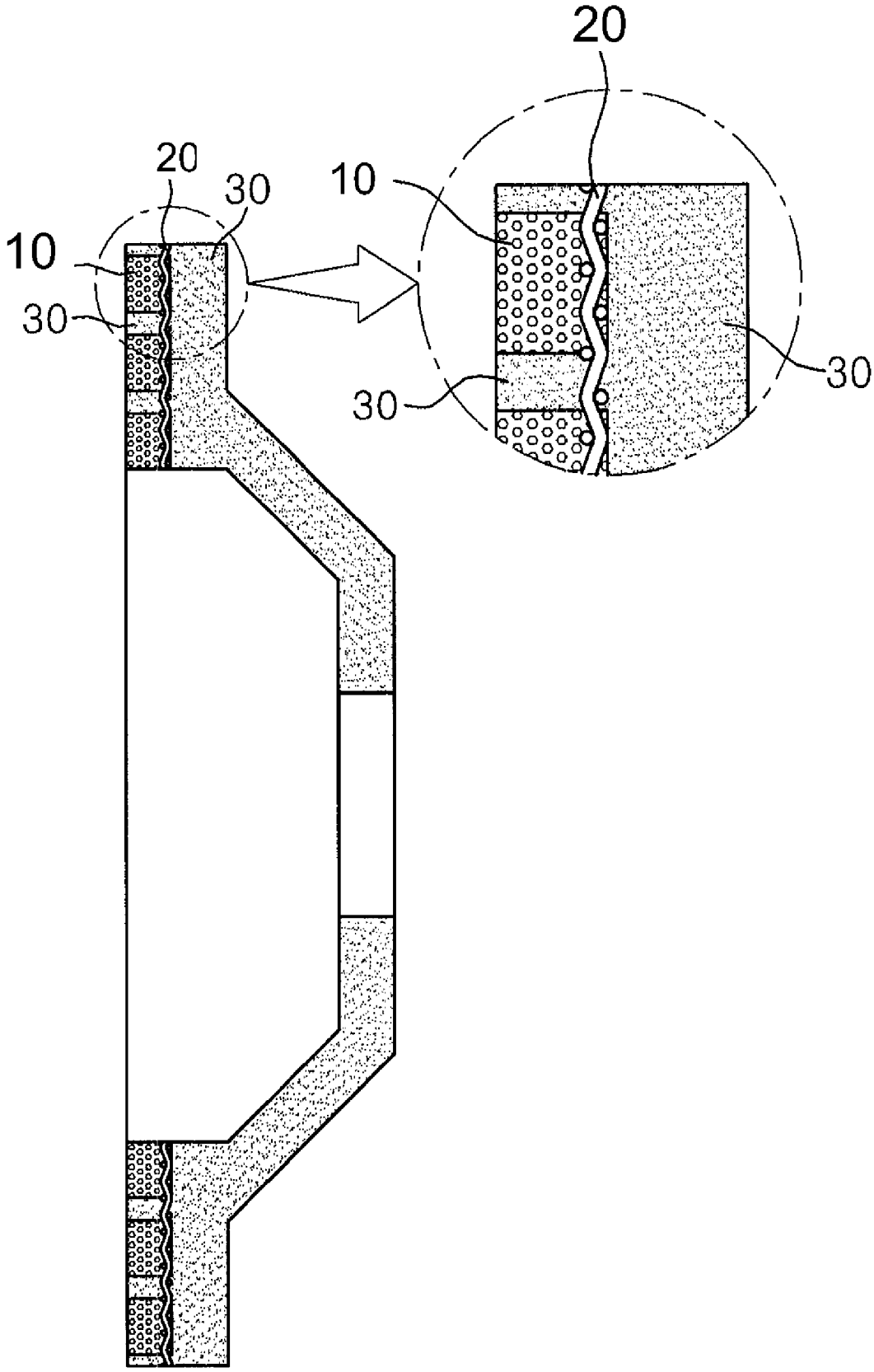
FIG. 3 is a sectional view of FIG. 2.

FIG. 1 is a front view of a mesh net, on which a diamond sintered body is sintered according to the present invention, FIG. 2 is a front view showing a state where a synthetic resin body is molded in the state of FIG. 1, and FIG. 3 is a sectional view of FIG. 2. As shown in FIGS. 1 to 3, a diamond sintered body 10 is generally slightly greater than other materials in wear resistance and strength. So, the diamond sintered body 10 has been used in fields, which need excellent strength and wear resistance, such as cutting tools, excavating tools, and wire drawing dies.

Various technologies of such a diamond sintered body have been known.

For instance, Japanese Patent Laid-Open Publication No. Sho52-12126 describes the following contents. A diamond sintered body can be obtained by conducting the steps of filling a container fabricated with WC—Co cemented carbide with diamond powder, and infiltrating and sintering Co—W—C eutectic liquid from a cemented carbide substrate into the diamond powder at high-temperature and high-pressure.

Moreover, Japanese Patent Laid-Open Publication No. Sho54-114513 describes the following contents. A diamond sintered body can be obtained by conducting the steps of previously mixing diamond powder and powder containing solvent metal of an iron group and keeping the mixture at high-temperature and high-pressure, where diamond can be obtained. Furthermore, Japanese Patent Laid-Open Publication Nos. Sho63-190756 and Hei6-32655 or Inorganic Material Institute Report No. 58 (Page to 48) describe a method for obtaining a high-density diamond sintered body by conducting the steps of coating sintering aid on the surfaces of diamond powder particles and sintering the coated diamond powder.

In addition, to prevent a deterioration of a diamond sintered body at high temperature, Japanese Patent Laid-Open Publication No. Hei6-6769 discloses a method for obtaining the diamond sintered body by conducting the steps of coating transition metal, B or Si on the surfaces of diamond powder particles and sintering the coated diamond powder into a solid state.

Besides the above, there are various methods for manufacturing a diamond sintered body. In the present invention, a flexible tool is made using a diamond sintered body 10 of a metal component manufactured in various methods.

Moreover, the present invention is to provide a structure applicable when a firm coupling with hetero-materials is needed.

In the meantime, a mesh net 20 according to the present invention is in a disc form made in such a way as to cross and couple iron materials with one another vertically and horizontally. Diamond sintered bodies 10 are arranged on the outer surface of the mesh net 20 in multiple arrays at regular intervals, and simultaneously impregnated into the mesh net 20.

Additionally, the mesh net 20 may be fabricated into a flat form, but it is preferable that the mesh net 20 is fabricated by crossing a horizontal metal wire and a vertical metal wire at right angles for an easy coupling with the diamond sintered body 10. As described above, if the mesh net 20 is fabricated by crossing the horizontal metal wire and the vertical metal wire at right angles, it can be bonded with the diamond sintered body more firmly.

Figure 4:
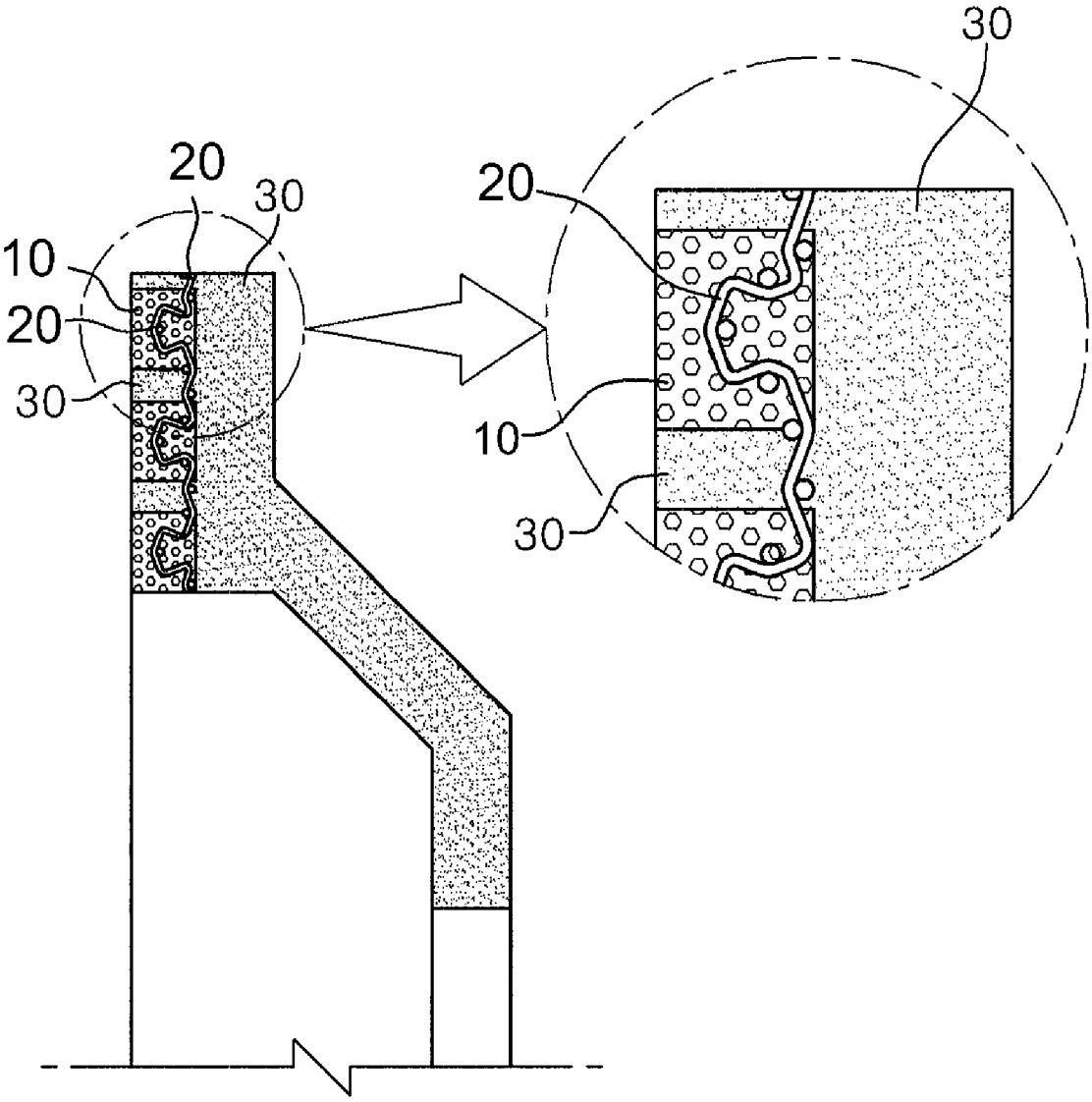
FIG. 4 is a half-sectional view showing another example of the mesh net according to the present invention.

FIG. 4 is a half-sectional view showing another example of the mesh net according to the present invention. As shown in FIG. 4, the mesh net 20 has embossed portions formed at locations corresponding to the diamond sintered bodies 10. So, a coupling area between the diamond sintered bodies 10 and the mesh net 20 can be increased, whereby a coupling force between the diamond sintered bodies 10 and the mesh net 20 is more improved.

As another example of the mesh net 20, the mesh net 20 may be fabricated in such a way as to form a number of through-holes on a metal sheet.

Furthermore, in this embodiment of the present invention, the mesh net 20 is in a disc form, but may be in a cylindrical form according to the form of the tool. In this instance, it is possible that the diamond sintered bodies are coupled to the outer circumference of the mesh net and the synthetic resin body is mounted to the inner circumference of the mesh net. That is, the mesh net 20 can be fabricated in various forms according to the outward appearance of the tool.

Meanwhile, the synthetic resin body 30 according to the present invention is constructed of a disc form, which is coupled with the mesh net 20 in such a way as to abut on the inner surface of the mesh net 20. Moreover, the synthetic resin body 30 is in an approximately tapered cylinder form to be coupled with a power transmission device.

A synthetic resin material constituting the synthetic resin body 30 can be classified into two: one being thermoplastic resin, which is molded with fluidity by heating as a high molecular substance; and the other being thermosetting resin of a low molecular substance, which obtains fluidity while being heated and pressurized in a mold and is highly-polymerized by a chemical action, and so, does not have fluidity even though it is heated after that. In addition, the synthetic resin material can be generally classified according to the forms of high molecules. So, chemical fiber and rubber containing synthetic fiber are used for composite polymer compound, but fiber, plastic and rubber are used for linear polymer. Moreover, rubber is the weakest but fiber is the strongest in an attracting force between molecules.

The present invention can utilize all of the synthetic resin materials, such as rubber or plastic, which can be classified as described above. The greatest reason to use the synthetic resin materials is to reduce weight to thereby provide convenience in delivery and use.

The synthetic resin body 30 extends and is impregnated into a coupled portion of the diamond sintered body 10 after penetrating the mesh net 20 since its initial material is in a liquid state. So, the synthetic resin material infiltrates into the remaining space excepting an area where the diamond sintered body 10 exists, and then, is solidified and firmly coupled with the mesh net 20. So, the mesh net 20 and the synthetic resin body 30 are closely and firmly coupled with each other, whereby coupling between materials of different kinds can be achieved very easily.

In the present invention, the sintered body 10 and the mesh net 20 are formed integrally in such a way that the metal sintered body 10 is molded and sintered on the metal mesh net 20. In addition, if rubber or urethane is molded on the mesh net to form the body, the tool having flexibility can be fabricated.

In this instance, an exposed portion of the metal mesh net 20 integrated with the metal sintered body 10 constituting the diamond tip keeps its firmness since hetero-materials made of the synthetic resin material, such as rubber or urethane plastic are impregnated therein deeply. The method according to the present invention can be applied even to the form of the tool having the metal body of the metal bonding tool fabricated by the existing diamond tool fabricating method, which has no flexibility and does not overcome a restriction in a method for coupling the metal sintered tip and the body with each other.

INDUSTRIAL APPLICABILITY

As described above, the diamond tool according to the present invention can maximize a bonding strength by impregnating the synthetic resin material for the body through the inner surface of the mesh net since the diamond sintered body is coupled integrally with the outer surface of the mesh net. In addition, the diamond tool according to the present invention can minimize its weight, and so, maximize convenience in delivery and work.

While the present invention has been described with reference to the particular illustrative embodiment, it is not to be restricted by the embodiment but only by the appended claims. It is to be appreciated that those skilled in the art can change or modify the embodiment without departing from the scope and spirit of the present invention.

The invention claimed is:

1. A diamond tool fabricated by combining a mesh net with a synthetic resin material comprising: a diamond sintered body having a diamond tip being molded and sintered on a mesh net; the mesh net integrally coupled with the sintered body in such a way that a portion of the sintered body is impregnated into the mesh net; and a synthetic resin material for forming a synthetic resin body in such a way as to couple the mesh net with the circumference of the sintered body to thereby expose the sintered body to the outside.

2. The diamond tool according to claim 1, wherein the mesh net is formed in such a way as to cross metal wires.

3. The diamond tool according to claim 1, wherein the mesh net has an embossed portion formed at a location corresponding to the diamond sintered body.

4. The diamond tool according to claim 1, wherein the mesh net is in an annular disc form.

5. The diamond tool according to claim 1, wherein the synthetic resin material is selected from a group containing rubber, urethane and plastic.

6. The diamond tool according to claim 1, wherein the diamond sintered body is a metal diamond sintered body.

7. The diamond tool according to claim 1, wherein the mesh net is a metal mesh net.

8. The diamond tool according to claim 1, wherein the mesh net is a metal sheet having a number of through-holes.

9. The diamond tool according to claim 1, wherein the synthetic resin material is thermoplastic resin or thermosetting resin.

10. The diamond tool according to claim 1, wherein the synthetic resin material is adapted to form a body in such a way as to be coupled with the sintered body at the same height as the top of the sintered body to thereby expose the top of the sintered body to the outside.

11. The diamond tool according to claim 1, wherein the diamond sintered bodies are arranged on a concentric circle in a circumferential direction at regular intervals.

* * * * *